US005232102A

United States Patent [19]

Ozawa

[11] Patent Number: 5,232,102

[45] Date of Patent: Aug. 3, 1993

[54] AUXILIARY DISPLAY RACK

[76] Inventor: Kenzo Ozawa, 1-4-15-714 Seishin-cho, Edogawa-ku, Tokyo, Japan

[21] Appl. No.: 875,220

[22] Filed: Apr. 24, 1992

Related U.S. Application Data

[63] Continuation of Ser. No. 729,714, Jun. 28, 1991, abandoned.

[30] Foreign Application Priority Data

Sep. 6, 1990 [JP] Japan ..... 2-93802[U]

[51] Int. Cl.[5] ..... A47F 7/00

[52] U.S. Cl. ..... 211/49.1; 211/59.2; 211/175

[58] Field of Search ..... 211/86, 184, 175, 59.2, 211/59.3, 50, 49.1

[56] References Cited

U.S. PATENT DOCUMENTS

| | | | |
|---|---|---|---|
| 945,877 | 1/1910 | Updegraff | 211/43 |
| 1,703,987 | 3/1929 | Butler | 211/59.3 X |
| 1,714,266 | 5/1929 | Johnson | 211/189 X |
| 2,145,563 | 1/1939 | Watson | 211/59.3 X |
| 2,440,701 | 5/1948 | Sharpe | 211/50 |
| 2,516,122 | 7/1950 | Hughes | 211/184 |
| 2,987,195 | 6/1961 | Smith | 211/175 |
| 3,194,402 | 7/1965 | Katz | 211/59.2 |
| 3,391,793 | 7/1968 | Streuli | 211/184 X |
| 3,487,949 | 1/1970 | Merkle | 211/55 X |
| 3,877,134 | 4/1975 | Shanahan | 211/41 X |
| 4,025,137 | 5/1977 | Wyler . | |
| 4,326,637 | 4/1982 | James | 211/175 |
| 4,463,854 | 8/1984 | MacKenzie | 211/184 X |
| 4,729,481 | 3/1988 | Hawkinson et al. | 211/59.3 |
| 4,830,201 | 5/1989 | Breslow | 211/184 |
| 4,958,891 | 9/1990 | Taylor et al. | 211/175 X |

FOREIGN PATENT DOCUMENTS

| | | | |
|---|---|---|---|
| 0215751 | 3/1987 | European Pat. Off. . | |
| 1-114868 | 8/1989 | Japan . | |
| 8102829 | 10/1981 | PCT Int'l Appl. | 211/40 |
| 627398 | 8/1949 | United Kingdom . | |

*Primary Examiner*—Blair M. Johnson
*Assistant Examiner*—Korie H. Chan

[57] ABSTRACT

In an auxiliary display rack for use on a display shelf and comprising left and right side panels connected at the front and rear ends by rod-like connecting members, the connecting members are made extensible and contractible for enabling the rack width to be adjusted to the width of merchandise to be displayed. When the panels are formed to be higher in the rear than in the front and the rear connecting member is positioned higher than the front connecting member, merchandise can be easily removed from the rack and the merchandise can be prevented from toppling when the rack is pulled forward to bring unsold merchandise at the rear thereof to the front of the shelf.

3 Claims, 4 Drawing Sheets

AUXILIARY DISPLAY RACK

This application is a continuation of application Ser. No. 07/729,714, filed Jun. 28, 1991, now abandoned.

BACKGROUND OF THE INVENTION

1. Field of the Invention

The present invention relates to an auxiliary display rack to be placed on a display shelf and used for displaying merchandise or other articles.

2. Description of the Prior Art

In supermarkets and other such establishments, different types of merchandise are frequently displayed on a display shelf as arranged side by side in the lateral (left-right) direction of the shelf, with the articles of the individual types of merchandise being arranged in rows in the depthwise (front-back) direction of the shelf.

As customers generally select the articles of merchandise nearest the front of the shelf, open spaces eventually occur at the front of the individual rows of merchandise. Moreover, since some types of merchandise move more quickly than others, these spaces come to differ in size from one type of merchandise to another and, as a result, the foremost article(s) of the different types of merchandise become out alignment in the lateral direction. This spoils the appearance of the displayed merchandise and also makes it difficult to see the first article(s) in the shorter rows because they become hidden behind the articles in the longer rows. It is therefore necessary to move the merchandise to the front of the shelf from time to time.

As a method for facilitating this work, Japanese Utility Model Publication No. 61(1986)-29327 proposes a method for displaying merchandise using an auxiliary display rack consisting of two parallelly disposed side panels spaced laterally from each other by a prescribed distance and extending in the depth direction, and two connecting members connecting the side panels at their front and rear ends. A number of such auxiliary display racks with different lateral panel spacings, each approximately equal to the width of the row(s) of the type of merchandise to be displayed therein, are arranged laterally on the display shelf in an aligned relationship relative to the depth of the shelf.

When this method of displaying merchandise is used, the unsold articles remaining in any of the auxiliary display racks can be moved to the front of the shelf by pulling the auxiliary display rack forward so as to cause the rear connecting member to push all of the articles forward at one time. At this time, since the articles in the rack are guided by the laterally spaced panels, they can be moved forward while being maintained in neat alignment in the depth direction. As a result, the merchandise can be moved and aligned simply and easily.

Notwithstanding its advantages, however, this conventional auxiliary display rack still leaves much to be desired in terms of utility.

Specifically, while different types of merchandise come in a great variety of different widths, the side panels of this conventional rack are spaced at a fixed distance. This makes it necessary to use a number of different types of racks with different panel spacing, which is quite troublesome.

Moreover, the conventional rack is inadequate as regards the ease with which articles can be removed therefrom and also as regards preventing the products from toppling when they are moved forward.

SUMMARY OF THE INVENTION

The object of the present invention is to provide an auxiliary display rack which can be easily adapted for use with various types of merchandise of different widths, which enables articles to be removed therefrom with ease, and which reduces the likelihood that articles displayed therein will topple.

For achieving this object, the present invention provides an auxiliary display rack comprising left and right side panels disposed in parallel at a prescribed distance from each other and front and rear extensible connecting members connecting the panels at their front and rear ends.

The rear connecting member is preferably disposed at a higher position than the front connecting member.

Further, the side panels are preferably formed to be taller at the rear end than at the front end.

DESCRIPTION OF THE PREFERRED EMBODIMENTS

The present invention will hereinbelow be described in further detail with reference to the accompanying drawings.

Figure 1:
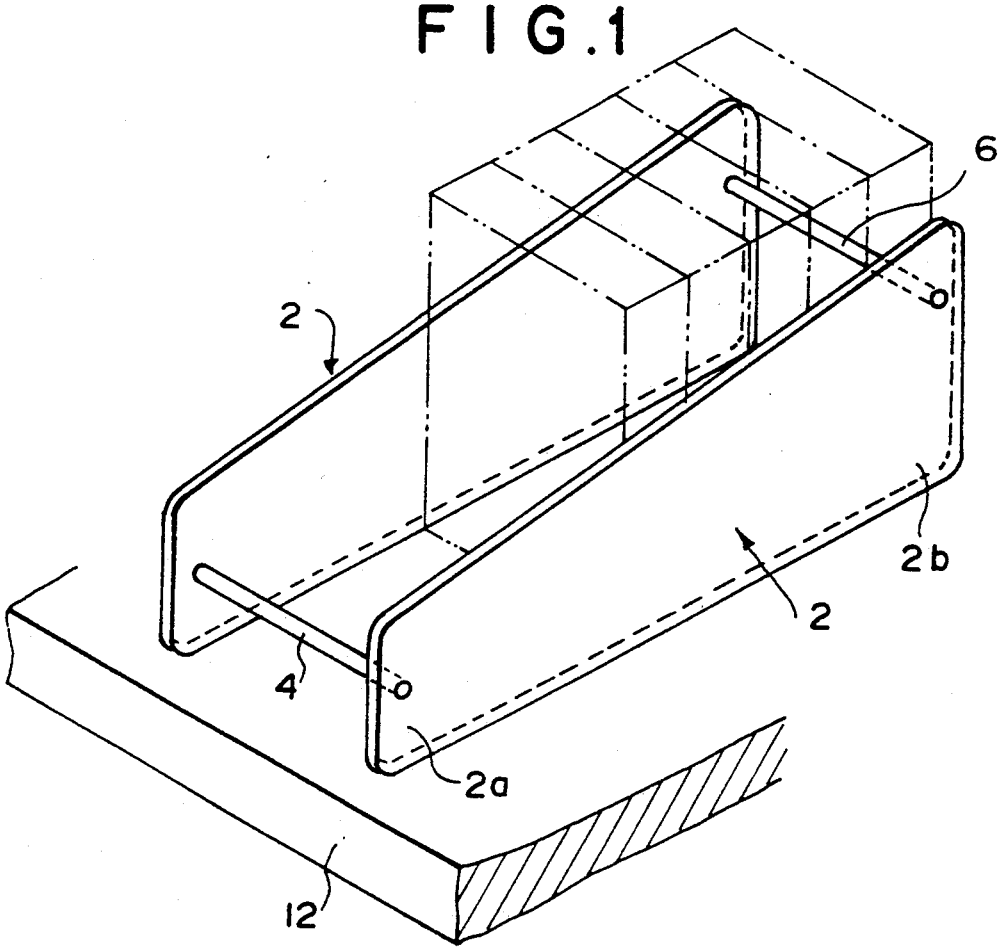
FIG. 1 is a perspective view showing an embodiment of the invention.

A perspective view of a first embodiment of the invention is shown in FIG. 1.

As illustrated, the auxiliary display rack according to this embodiment comprises left and right side panels 2, 2 disposed in parallel at a prescribed distance from each other and extending from front to back, an extensible front connecting member 4 connecting the front ends 2*a*, 2*a* of the side panels 2, 2, and an extensible rear connecting member 6 connecting the rear ends 2*b*, 2*b* of the side panels 2, 2. (By "extensible" here is meant that the member can be extended and contracted in length in the manner of a telescope.)

The panels 2, 2 are formed to be low in the front and high in the rear, and thus to have sloping upper edges, while the front connecting member 4 is disposed at a lower position than the rear connecting member 6.

Figure 2:
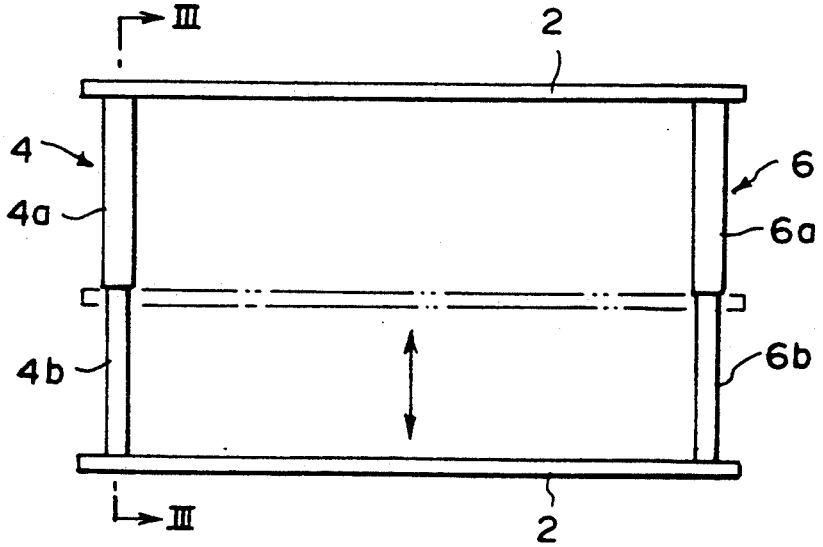
FIG. 2 is a plan view of the embodiment of FIG. 1.
Figure 3:
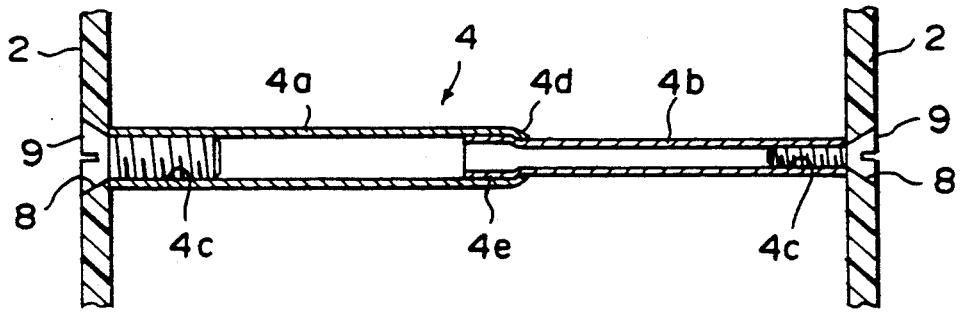
FIG. 3 is a sectional view taken along line III—III in FIG. 2.

As shown in the plan view of FIG. 2 and the sectional view taken along line III—III of FIG. 2 shown in FIG. 3, the extensible front and rear connecting members 4, 6 are constituted as telescopically extensible rods each consisting of an outer pipe 4*a* (6*a*) and an inner pipe 4*b* (6*b*) slidably accommodated inside the outer pipe 4*a* (6*a*). As shown in FIG. 2, the distance between the left and right side panels 2, 2 can be freely adjusted by extending or contracting the connecting members 4, 6.

As shown in the sectional view of the front connecting member 4 of FIG. 3, the outer ends of the outer pipe 4*a* and the inner pipe 4*b* are formed with internal female screws 4c, 4c and the side panels 2, 2 are formed with screw insertion holes 8, 8. The connecting member 4 is attached to the panels 2, 2 by inserting screws 9, 9 through the insertion holes 8, 8 and screwing them into the ends of the outer and inner pipes 4a, 4b to engage with the female screws 4c, 4c. The invention is, however, not limited to the foregoing method of attaching the connecting members to the panels and it is alternatively possible to achieve the attachment by use of a bonding agent, by force-fitting the ends of the connecting members into holes formed in the side panels, or by any other convenient method.

Figure 4:
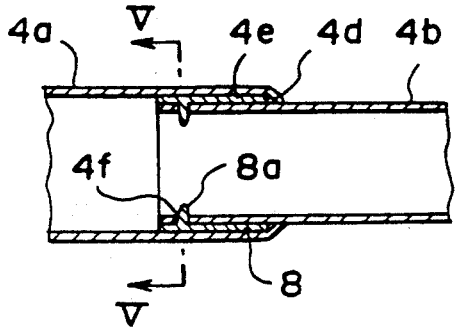
FIG. 4, is an enlarged view of one part of FIG. 3.
Figure 5:
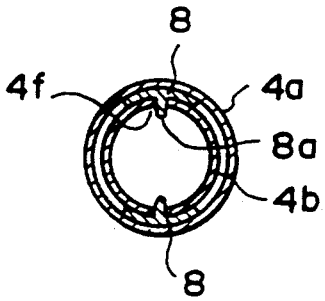
FIG. 5 is a sectional view taken along line V—V of FIG. 4.
Figure 6:
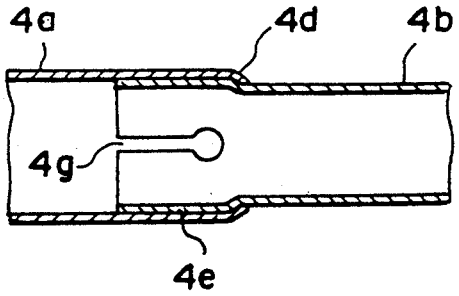
FIG. 6 is a sectional view similar to that of FIG. 4 but of another embodiment of the invention.

For preventing separation of the outer pipe 4a and the inner pipe 4b, the outer pipe 4a is formed at its inner end with a small-diameter reduced portion 4d while the inner pipe 4b is provided at its inner end with a large diameter portion 4e. As shown in FIG. 4 and the sectional view taken along line V—V of FIG. 4 shown in FIG. 5, the large diameter portion 4e can be formed fitting a stop piece 8 of a prescribed thickness over the inner end of the inner pipe 4b and immobilizing it with respect to the inner pipe 4b by engagement of a projection 8a of the stop piece 8 with a hole 4f formed in the inner pipe 4b. Alternatively, as shown in FIG. 6, the inner end of the inner pipe 4b can be formed with a slit 4g and then expanded to form the large diameter portion 4e. Any of various other methods can also be used for preventing separation of the inner and outer pipes.

The method used for attaching the rear connecting member 6 to the panels 2, 2 and that for preventing separation of its inner and outer pipes are the same as those used for the front connecting member 4.

An example of how the auxiliary display rack according to this embodiment is used will now be explained with reference to the plan views shown in FIGS. 7 and 8.

Figure 7:
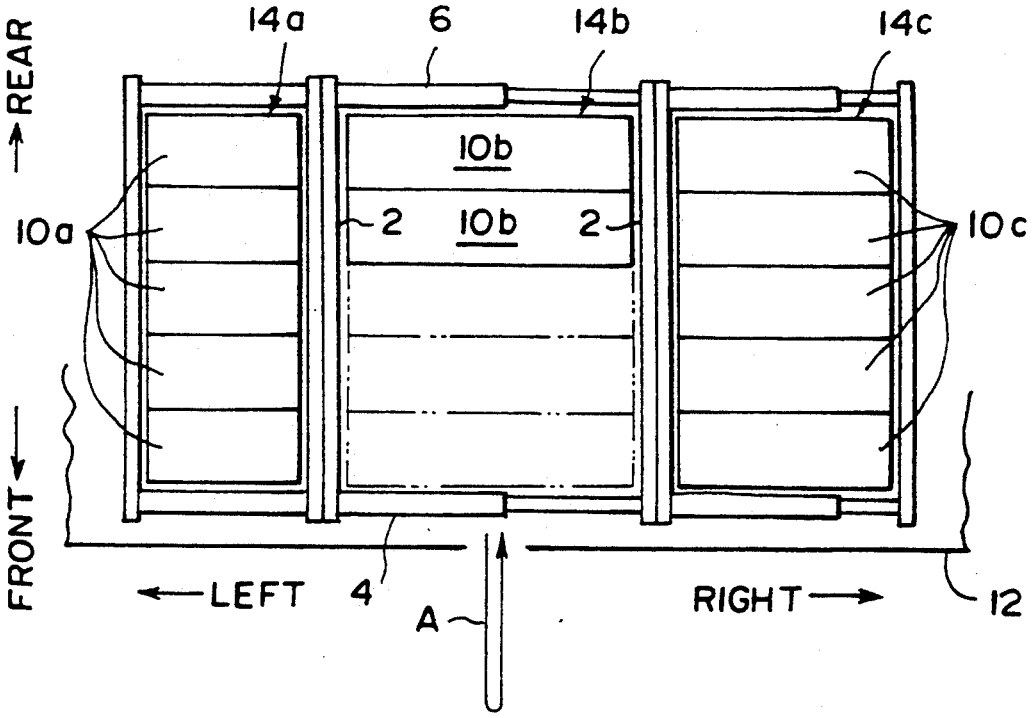
FIGS. 7 and 8 are plan views showing the embodiment of FIG. 1 in use.
Figure 8:
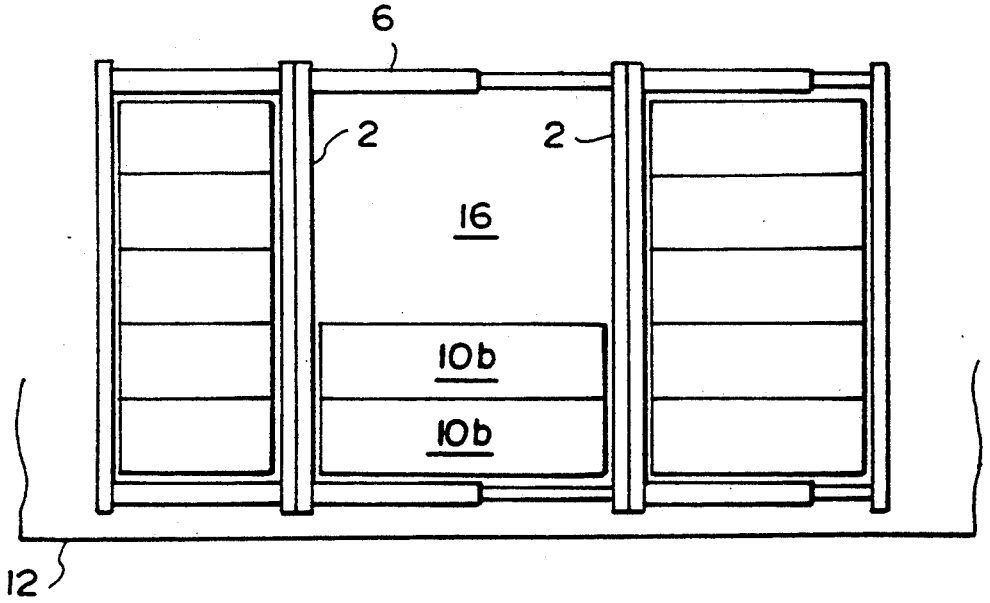

As shown in FIG. 7, a number of the auxiliary display racks are individually adjusted in lateral width (distance between the panels 2, 2) to match the types of merchandise 10a, 10b, 10c to be displayed therein, and are then placed side by side on a display shelf 12 and aligned with each other relative to the depth of the shelf 12. Articles of a specific type of merchandise are then placed in a row (14a, 14b or 14c) extending from back to front in each of the display racks.

Consider the case where three articles of merchandise 10b have been removed from row 14b (as indicated by the two-dot chain lines in FIG. 7). In this case it is desirable to move the remaining two articles to the front so as to bring the foremost one into alignment with the foremost articles in the rows 14a and 14c and, optionally, thereafter to place three new articles 10b behind the two articles 10b moved to the front. For this, as shown by the arrow A in FIG. 7, the center display rack is pulled forward to cause the rear connecting member 6 to push the remaining two articles forward and then, after these two articles have reached the desired position, the rack is pushed rearward to its initial position. As a result, the remaining two articles 10b are moved to the front as shown in FIG. 8. Next, if desired, new articles of merchandise can be placed in the space 16 now present behind the articles that were moved to the front.

When the auxiliary display rack of the foregoing structure is used for displaying merchandise, the work of moving unsold articles to, and arranging them at, the front of the display shelf can be carried out extremely simply merely by a single operation of pulling and pushing the rack. During this operation, since the articles are guided by the side panels 2, 2, they can be moved forward without disturbing their alignment in the depthwise direction. Thus, no troublesome work is necessary for realigning the articles.

Moreover, since the left and right side panels 2, 2 are connected by the extensible connecting members 4, 6, the distance between the panels can be freely adjusted. The auxiliary display rack can therefore be adapted for use with articles of merchandise of various sizes, making it unnecessary to use numerous different racks with fixed lateral widths matched to different types of merchandise. The rack according to this embodiment is thus very convenient.

In the conventional auxiliary display rack referred to earlier, the front connecting member is positioned at the same height as the rear connecting member. This is disadvantageous because when the vertical position of the connecting rods is selected such that the front connecting member is at a low position where it does not interfere with the removal of the merchandise from the rack, the rear connecting member will push against the lower part of the merchandise when the row of merchandise is moved to the front so that the merchandise will be likely to topple to the rear. On the other hand, if the vertical position is selected to eliminate this problem, the front connecting member will be at a high position where it interferes with the removal of merchandise from the rack. When the front connecting member is position low and the rear connection member is positioned high as in the embodiment of the invention just described, however, it becomes possible to ensure both ease of merchandise removal and freedom from the danger of merchandise toppling during pull-out.

Moreover, the side panels of the conventional auxiliary display rack are of rectangular shape and have the same height at the front and back. This is disadvantageous because when the height is too great, it becomes difficult to remove merchandise from the rack, and when it is too small, the merchandise is apt to topple sidewise when the row of merchandise is moved to the front or to topple rearward owing to the fact that the rear connecting member cannot be disposed at a high position. When the side panels are formed to be low in the front and high in the rear as in the embodiment of the invention just described, however, it becomes possible to ensure both ease of merchandise removal from the front and freedom from danger of merchandise toppling during pull-out.

Figure 9:
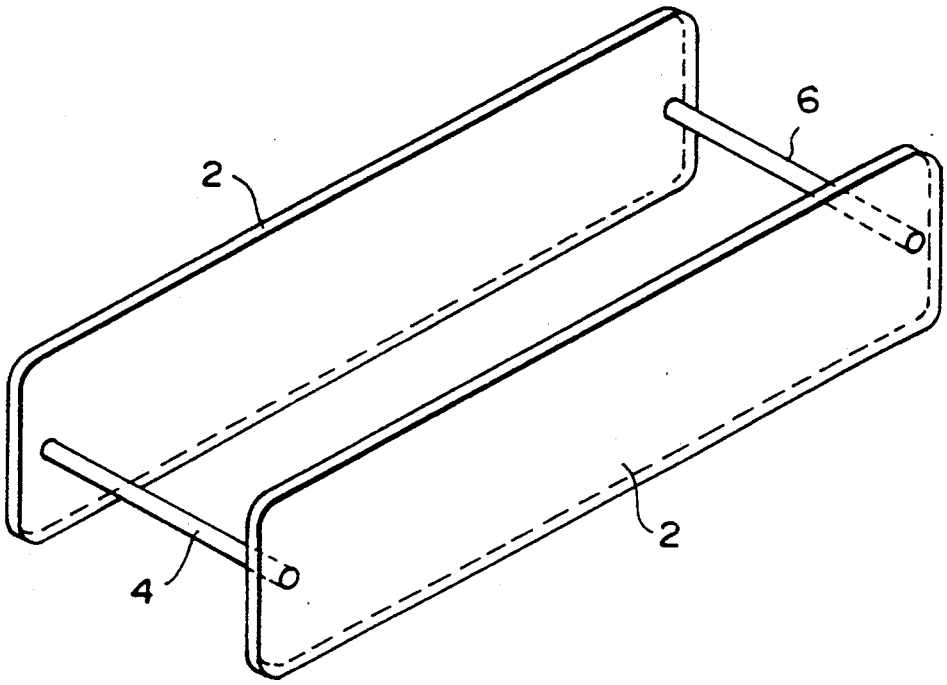
FIGS. 9 and 10 are a perspective view and a side view of another embodiment of the invention.

It should be noted however that it is not absolutely necessary for the side panels 2, 2 to be low in front or for the front connecting member 4 to be positioned lower than the rear connecting member 6. As shown in FIG. 9, it is, for example, alternatively possible to use an arrangement in which the panels 2, 2 are of a rectangular shape having the same height at the front and rear, and to position the front and rear connecting members 4, 6 at the same height.

Figure 10:
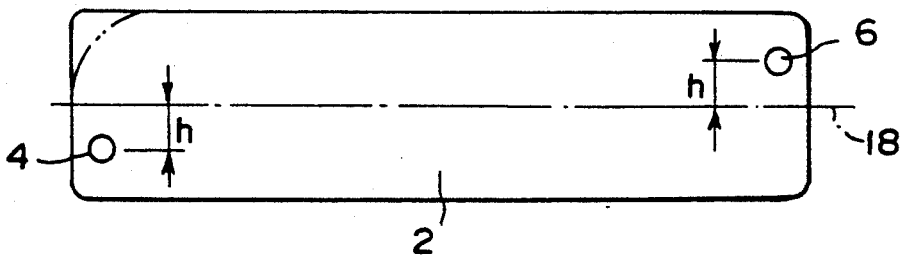

Moreover, where rectangular side panels 2, 2 of the same height at the front and rear are used, the attachment of the front connecting member 4 at a low position and the rear connecting member 6 at a high position can, for example, be accomplished as shown in FIG. 10 by positioning the two connecting members 4, 6 to fall below and above the panel center lines 18, 18 by the same distance h. This arrangement is convenient in that it allows the rack to be used either side up. When rectangular side panels 2, 2 of the same height are used, the ease with which merchandise can be removed from the rack can be improved by forming the panels to have arcuate front ends, as shown by the two-dot chain line in FIG. 10.

As explained in the foregoing, the auxiliary display rack according this invention comprises left and right side panels connected with each other via extensible connecting members. Owing to this arrangement, the rack can be adjusted to match the widths of various different kinds of merchandise. It is thus extremely convenient since it eliminates the need for using racks with various different fixed widths.

Moreover, according to one aspect of the invention, since the rear connecting member is positioned higher than the front connecting member and the front ends of the side panels are made shorter than the rear ends thereof, the ease with which merchandise can be removed from the rack is enhanced while, at the same time, the likelihood of articles within the rack toppling when they are moved forward is greatly reduced.

I claim:

1. A display system comprising:

(a) a fixed planar supporting surface having a front portion and a rear portion;

(b) an auxiliary display rack, said rack being bottomless and resting on said supporting surface, said rack comprising left and right elongate side panels disposed in parallel at a prescribed distance from each other, said side panels each having a front end and a rear end, wherein said rear ends are greater in height than said front ends, and an underside between said front and rear ends to enable the rack to be slidable on said supporting surface, said side panels each having a smooth interior surface, and at least one front and at least one rear connecting members interconnecting the side panels at said front and rear ends, said connecting members being extendible in a transverse direction so that said prescribed distance between said left and right side panels can be varied, at least one of said rear connecting members being positioned higher than said front connecting members;

(c) a plurality of articles abutting one another housed in said display rack between said front and rear connecting members, said articles each having a front surface and a rear surface opposite said front surface, whereby said front surfaces of said articles face toward said front connecting member, and an underside surface adapted to rest on and being supported by said supporting surface, and the articles each having side surfaces abutting said smooth interior surfaces of said side panels in a longitudinal alignment;

whereby when at least one of the forwardmost article adjacent said front connecting member is removed from said rack, the rack is adapted to be drawn forward in a drawing direction parallel to said longitudinal alignment of said articles and parallel to a longitudinal axis of said side panels such that the rear connecting member pushes said rear surface of the rearmost article to draw the entire plurality of longitudinally aligned articles forward with the rack to said front portion of said planar supporting surface with said smooth interior surfaces of said side panels guiding said side surfaces of said articles forward without disturbing said longitudinal alignment of said articles, and whereby the rack may be pushed back toward said rear portion of said supporting surface with said smooth interior surfaces sliding past said side surfaces of said articles enabling said articles to rest in said front portion of said planar supporting surface.

2. A display system according to claim 1, wherein said side panels of said display rack are trapezoidally shaped.

3. A display system according to claim 1, wherein said connecting members of said display rack are formed of telescopically extendible rods.

* * * * *